United States Patent [19]

Hof et al.

[11] 4,425,998

[45] Jan. 17, 1984

[54] PROTECTIVE PACKAGING FOR THERMOLABILE GOODS USING COMPOUNDS WITH MELTING POINTS SLIGHTLY BELOW THERMOSENSITIVE TEMPERATURE OF THE GOODS

[75] Inventors: Craig R. Hof, Hopatcong; Hasmukh Shah, Irvington, both of N.J.

[73] Assignee: PyMaH Corporation, Sommerville, N.J.

[21] Appl. No.: 470,333

[22] Filed: Feb. 28, 1983

Related U.S. Application Data

[60] Continuation of Ser. No. 112,753, Jan. 17, 1980, abandoned, which is a division of Ser. No. 15,080, Jan. 26, 1979, which is a continuation-in-part of Ser. No. 946,467, Sep. 28, 1978, abandoned.

[51] Int. Cl.[3] ..... B65D 81/18; B65D 81/24; B65D 85/20; B65D 85/24

[52] U.S. Cl. ..... 206/306; 206/212; 206/526; 206/443; 62/371; 220/441; 220/444; 428/920

[58] Field of Search ..... 206/526, 306, 212, 205, 206/443, 523; 428/920; 220/88 R, 441, 444, 452, 902; 62/371

[56] References Cited

U.S. PATENT DOCUMENTS

| | | | |
|---|---|---|---|
| 2,989,856 | 6/1961 | Telkes | 62/371 |
| 3,236,206 | 2/1966 | Willinger | 62/371 |
| 3,366,226 | 1/1968 | Baklor | 206/306 |

*Primary Examiner*—William T. Dixson, Jr.
*Attorney, Agent, or Firm*—Wegner & Bretschneider

[57] ABSTRACT

There is disclosed a method for protecting thermolabile goods from degradation or destruction from high temperatures by surrounding the goods with a compound having a melting point about 3° to about 5° C. lower than the thermosensitive temperature of the goods and a heat capacity sufficient to protect the goods when the temperature of the environment exceeds the temperature of the goods. A representative compound is sodium sulfate decahydrate also known as Glauber's salt. In a preferred embodiment, the compound prior to use is melted, absorbed in a bibulous material, and then sealed in a plastic bag. In still another preferred embodiment, the method surrounds the compound with a layer of outer insulation which is adjacent to the outside container, which is made of cardboard, paper, and/or wood.

46 Claims, 2 Drawing Figures

PROTECTIVE PACKAGING FOR THERMOLABILE GOODS USING COMPOUNDS WITH MELTING POINTS SLIGHTLY BELOW THERMOSENSITIVE TEMPERATURE OF THE GOODS

This is a continuation of application Ser. No. 112,753 filed Jan. 17, 1980, now abandoned, which in turn is a division of application Ser. No. 015,080 filed Jan. 26, 1979, which in turn is a continuation-in-part of application Ser. No. 946,467 filed Sept. 28, 1978, now abandoned.

The present invention relates to a method of protecting thermolabile goods from degradation if the goods happened to be subjected to high temperatures.

REFERENCE TO RELATED APPLICATIONS

The subject matter of the instant invention is related in part to U.S. patent applications Ser. No. 796,492 filed May 12, 1977 (now abandoned); Ser. No. 844,334 filed Oct. 21, 1977; Ser. No. 895,422 filed Apr. 13, 1978; and Ser. No. 946,935 filed on Sept. 28, 1978, all in the names of Craig R. Hof and Roy A. Ulin, entitled "Temperature Indicating Compositions of Matter"; and Ser. No. 946,466 also filed on Sept. 28, 1978 in the names of Gerald W. McNeeley, Roy A. Ulin, and Craig R. Hof, entitled "Temperature Indicator useful As A Steam Trap Monitor."

BACKGROUND OF THE INVENTION

1. Field of the Invention

This invention relates to the field of insulation and to the protection of temperature-sensitive materials.

2. Description of the Prior Art, and Other Information

An embodiment of this invention was first sold in commerce on or about Mar. 21, 1978.

Many items of commerce are subject to degradation or destruction by excessively high temperatures, e.g., single-use clinical thermometers, food, and enzymes, antigens, antibodies, or protein substances used in immunoassays or agglutination tests, and other biological or organic substances such as vaccines, sera, etc. Exposure of clinical thermometers for example, to temperatures above 96° F. will cause them to "fire", i.e.. to record the exposed temperature and become unusable for further temperature measurement. Typically, products such as clinical thermometers are shielded from the adverse effects of high shipping and storage temperatures through heavily insulated shipping cartons containing ice (solid water) as refrigerant—a method which has obvious shortcomings.

Other methods of refrigeration using chemicals are known but these methods require the additional presence of water in order to achieve the refrigeration effect and thus lend themselves to many of the same shortcomings or disadvantages as the use of ice alone as a refrigerant, i.e., melting at a relatively low temperature (32° F.), bulk, and relatively minor heat exchange.

It is known to use sodium nitrate as a part of a refrigerant mixture from U.S. Pat. No. 1,728,364 to Rivard. However, it is also necessary to use water and fine gravel to achieve the refrigerant effect. Various chemicals for refrigeration are also described in U.S. Pat. No. 2,013,946 to Bennett and U.S. Pat. No. 2,185,799 to Blake. It is necessary here to combine the chemicals with water to produce an effective refrigerant.

OBJECTS OF THE INVENTION

It is an object of the present invention to provide a chemical method for protecting thermolabile goods that does not require the use of water in either liquid or solid form.

It is another object of the present invention to provide a chemical method for protecting thermolabile goods that permits ready shipping of the goods to be protected because the chemical in ordinarily in solid form at shipping temperatures.

It is but another object of the present invention to provide a chemical method for protecting thermolabile goods wherein protection is provided by the ability of the chemical to absorb heat at a rate sufficient to protect the goods when the temperature of the environment exceeds the melting point of the chemical.

SUMMARY OF THE INVENTION

The present invention is directed to a method (and container to employ said method) for protecting thermolabile goods from degradation or destruction by thermosensitive temperatures, particularly excessively high temperatures, by surrounding the goods with a chemical having a melting point slightly less than the thermosensitive temperature of the goods and the capacity to absorb heat at a rate sufficient to protect the goods when the temperature of the environment exceeds the melting point of the compound. By "thermosensitive temperature", we mean the temperature at which a given property or characteristic of a substance to be protected begins to be affected in a discontinuous or abrupt or predetermined manner as a function of temperature, e.g., it may be a melting point, a freezing point, a temperature at which the property or characteristic is affected by relative short exposure (several days) to degradation or deterioration. By "slightly less" we mean a temperature commencing from about 1° C. to about 20° C. or 30° C. below the thermosensitive temperature, and in special circumstances even many degrees below the thermosensitive temperature, as will be described, infra.

Preferably, the melting point of the compound protecting the thermolabile goods is from about 3 to about 10° C. and most preferably, from about 3 to about 5° C. less than the thermosensitive temperature of the thermolabile goods being protected.

It is also preferred that the heat capacity of the melted chemical be about at least 10 cal/g to effectively protect the thermolabile goods.

In a preferred embodiment, the method surrounds the compound with a layer of outer insulation which is adjacent to the outside container, which is made of cardboard, paper, and/or wood.

DESCRIPTION OF THE PREFERRED EMBODIMENTS

Figure 1:
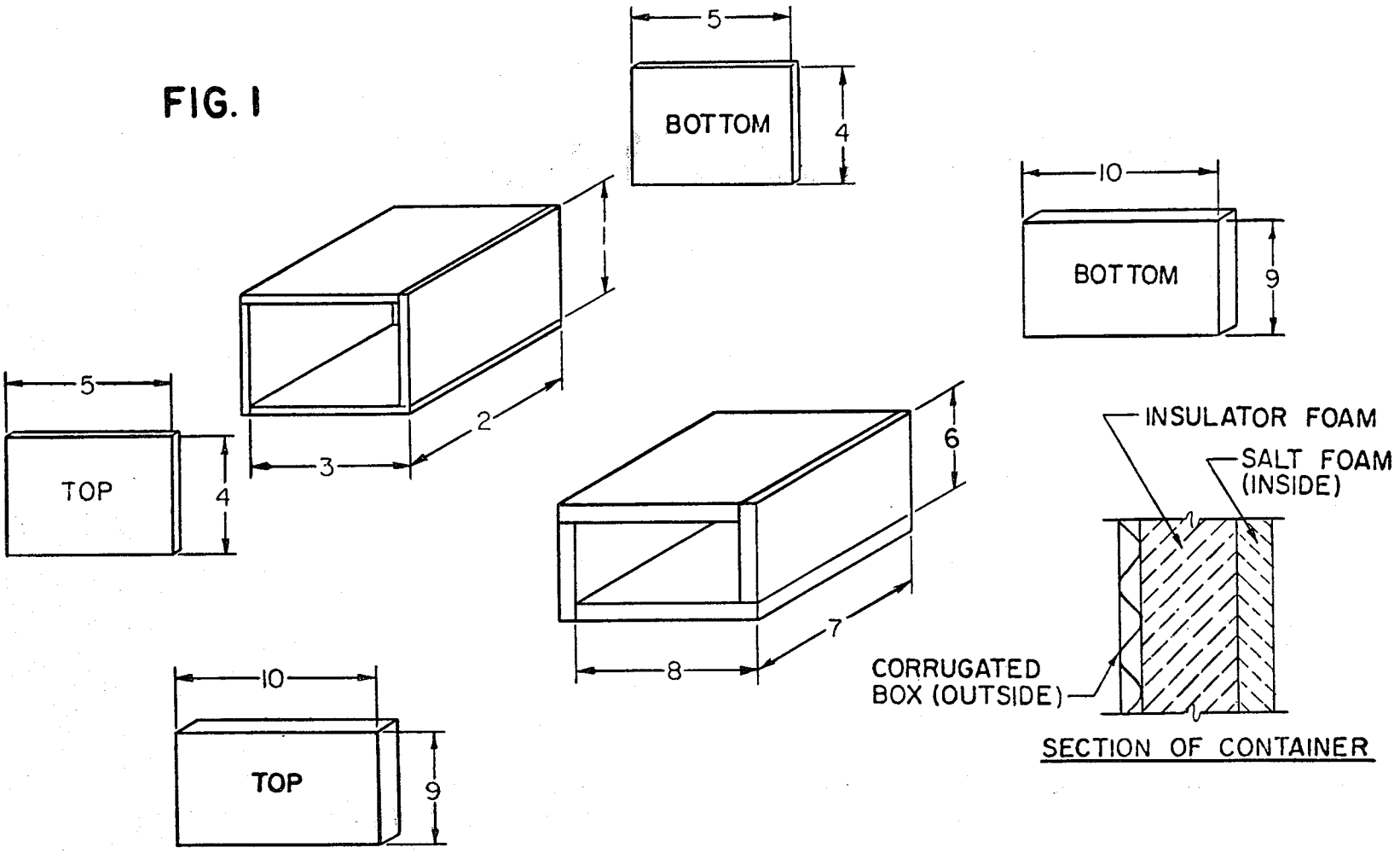

The following is a description of the invention in a variety of specific embodiments or modes.

It has been discovered, unexpectedly, that protective packaging of heat labile goods can be greatly improved by using certain salts, notably sodium sulfate decahydrate, e.g. Glauber's salt, as the refrigerant. Glauber's salt acts as a refrigerant as follows: the melting point of Glauber's salt is 32.38° C. A clinical thermometer such as described in copending application Ser. No. 895,422 filed Apr. 13, 1978, begins to indicate temperature at 35.5° C. When the clinical thermometers are packaged with Glauber's salt and exposed to high temperatures, for example 50° C., the temperature of the package rises until it reaches 32.28° C. At that temperature, the Glauber's salt begins to melt and absorb heat (energy) at a capacity of about 54 cal/gram. The package will remain at about 32° C. until the salt has been consumed.

Ice, on the other hand, can only be loaded into the package immediately before anticipated thermal abuse since it will melt and lose its refrigeration capacities in storage at normal temperature (i.e. approximately 70° F.).

A further advantage of the invention over commonly used refrigeration relates to its ability to preserve the goods for extended periods of time. The rate of thermal conductivity through any material, including insulation, is directly proportional to the difference in temperature on either side of the material or insulation. When ice is used as refrigerant in an exposure to 100° F., the difference in temperature is 68° F. With Glauber's salt, however, the difference in temperature is only 10.4° F. (100° F.–89.6° F.). Thus, the rate of heat flow with Glauber's salt is less than 1/6 the rate of heat flow with ice as refrigerant. The result of the differences in temperature and heat of fusion between Glauber's salt and ice is that one pound of Glauber's salt will preserve the goods in the package as well as 4.5 pounds of ice during exposure to 100° F. Therefore, if a compound such as Glauber's salt is employed aone, it is employed in such a calculable effective amount to protect the contents (preferable in even thickness around the contents to be protected) i.e., in an amount effective as to absorb a given amount of heat in a given environment having an ambient temperature sufficient to protect the contents for a predetermined amount of time.

For the application of preserving single-use thermometers sodium sulfate decahydrate or calcium chloride hexahydrate are well suited, other thermally labile goods or applications may require alternate salts or compounds. As previously mentioned, the chemical refrigerant should be selected as one having a melting point about 3 to about 5° C. below the labile temperature, or the thermosensitive temperature of the goods. The amount of refrigerant is dependent upon the thickness of insulation and surface area/volume ratio of the package, the amount of time and the temperature for which the goods need protection.

An example of another usable salt is sodium metaphosphate trihydrate (e.g. Knorre's salt) which melts at 53° C. and can be used to protect things labile at 57° C., or above. There are many more examples of usable inorganic compounds (e.g. potassium iron (III) sulfate.$24H_2O$, M.P.=28° C.) but organic compounds may be substituted. Thus, Glauber's salt may be replaced with o-chloronitrobenzene in the application with single-use thermometers.

It is desirable to package the novel refrigerant as with the classical refrigerant, ice. The novel refrigerant may be sealed in a flexible polypropylene plastic bag or closed in a rigid container. The purpose of such a package is to prevent contamination and moisture exchange taking place as well as to prevent the molten refrigerant from contaminating the goods being thermally shielded.

While the use of the above "novel refrigerants" has many advantages, there are some minor problems. First, unless cast into a solid block, the novel refrigerants are generally formless powders which can be difficult to handle. Further, upon melting, they form liquids which are free to flow into new geometrics within their container, if flexible.

It has been found that these problems can be overcome by absorbing the molten novel refrigerant into a bibulous material such as open cell foam, paper, natural or synthetic sponge and the like, sealed to exclude contamination and, for hydrated salts, water vapor exchange by enclosing the structure in a flexible plastic bag, for example.

The novel refrigerant, so packaged, is easy to handle, retains its shape when the refrigerant is molten, and prevents the refrigerants from sagging from its intended location within the package.

An example of such a packaged novel refrigerant is sodium sulfate decahydrate absorbed into a block of open cell phenol-formaldehyde foam and contained in a polyethylene bag closed by heat sealing. When placed in an insulated container, the novel refrigerant block protects the contents from exposure to high temperature in the same fashion as the unsupported Glauber's salt.

Other salts that can be used as a refrigerant packaging material are:

| Compound | M.P., °C. | Enthalpy of Solution |
|---|---|---|
| Ammonium iron (III) sulfate, $NH_4Fe(SO_4)_2.12H_2O$ | 39–41° C. | |
| Ammonium Propionate $NH_4C_3H_5O_2$ | 45° C. | |
| Cadmium Nitrate | 59° C. | |
| Calcium Chloride hexahydrate $CaCl_2.6H_2O$ | 29.9° C. | 18 cal/grm |
| Sodium Acetate trihydrate $NaC_2H_3O_2.3H_2O$ | 58° C. | 40 cal/grm |
| Sodium Monohydrogen Arsenate $NA_2HA_5O_4.7H_2O$ | 125° C. | |
| $12H_2O$ | 28° C. | |
| Sodium Tetraborate decahydrate $Na_2B_4O_7.1OH_2O$ | 75° C. | 44 cal/grm |
| Sodium Potassium tartrate tetrahydrate, $NAK_4C_4H_4O_6.4H_2O$ | 70–80° C. | |
| Sodium Meta Silicate pentahydrate $Na_2SiO_3.5H_2O$ | 72.2° C. | |
| Zinc Sulfate heptahydrate $ZnSO_4.7H_2O$ | 100° C. | 15 cal/grm |
| Sodium orthophosphate decahydrate $Na_2PO_4.1OH_2O$ | 100° C. | |
| Sodium Valerate $NaC_5H_4O_2$ | 140° C. | |
| Potassium Formate $KCHO_2$ | 167.5° C. | |

The compounds listed herein are only examples and should not be construed as limiting the generic scope or range of the invention.

Values of enthalpy of solution reported in the table are very close to the values of enthalpy of fusion. Organic compounds which obviously have application to this invention are not listed here because they are of such number that any one skilled in the art could easily find a suitable material by consulting and selecting from Handbook tables of organic compounds bearing in mind the general objects of the present invention. See, for example, Utermark and Schicke, MELTING POINT TABLES OF ORGANIC COMPOUNDS, 2d ed., revised, Interscience Publishers, New York, 1963.

It will become readily apparent to one skilled in the art that to any other type of temperature-sensitive substance, one first ascertains the thermosensitive critical temperature at which the substance quickly starts to decompose or to become unstable. In the case of frozen food stuffs, this temperature generally is near the freezing point of water, e.g., 32° F.–35° F.; in the case of immunochemical regents this is about 25° C. to about 37° C. One then selects a suitable organic or inorganic compound as mentioned having a melting point at least about 3° C. to about 5° C. less than the thermosensitive temperature and proceeds to contain the substance to be protected within the suitable compound as described herein, and preferable, additional insulation as well. Of course, as one skilled in the art will appreciate, one may choose a suitable organic or inorganic compound with a melting point many degrees below the thermosensitive temperature of the substance to be protected and achieve some protection for goods. However, more utility is gained by selecting substances 3° C.–5° C. below said thermosensitive point. Variables will include time in transportation ambient temperature, and the reaction moieties of the substance to be protected.

Although the invention has been described with respect to the specific embodiments above, numerous variations and modifications will become evident to those skilled in the art without departing from the scope and spirit of the invention as described above, defined in the appended claims, and as shown in the following Examples:

EXAMPLE I

The following Examples demonstrate the synergistic effects of three components of one of our novel protective packaging methods; moreover, the preferred embodiments for a packaging system to ship disposable thermometers which will commence "firing" at 96° F.

We believe that in order for our novel protective packaging method to be most effective, a combination of salt pack and insulation must be used comprising the following elements: (1) an outside container, (2) any suitable insulation known to those in the art, such as polyurethane (PU), and (3) refrigeration packs between the load and the insulation. Each layer is preferably in a tight fitting engagement with the layer or load within. Further, we believe that in the preferred mode, the packages of salt should be on all sides of the load for maximum utilization of materials and minimum shipping cost. The insulator should be employed in an effective amount, e.g., an amount sufficient so that the rate of heat transfer through the insulator is less than the rate of heat transfer through the refrigeration packs. The relative and absolute thicknesses may therefore be calculated by means known to those in the art, or may be determined experimentally, and will vary according to the insulator and refrigeration materials selected and the ambient temperature to be expected.

Below are shown three Tables showing the time for a load of disposable thermometers inside a shipping container to reach 93° with various combinations of insulation, thickness and salt pack thickness. The temperature outside the oven was about 72° F. On Table I the synergistic effects are very clearly demonstrated. For example, in the case where polyurethane foam of 1½" thick is used by itself, the time to reach 93° in a 120° oven is three hours. With the same shipping pack using the salt pack instead of insulation, four hours are required for the inside of the package to reach 120° C.; however, it can clearly be seen that by combining the polyurethane insulation and the salt-laden foam, the time is increased in reaching 93° to 28 hours after inserting the carton in the 120° oven.

Based upon the data presented in Tables I, II, and III we have formulated what we believe to be the preferred embodiments for application to shipping single use disposable thermometers:

TABLE I

Insulation Protection of 2,000 Thermometer and Packer
Number of Hours to Reach 93° F. in 100° F./120° F. Oven

| | | | OUTER INSULATION | | | | | |
|---|---|---|---|---|---|---|---|---|
| | | | K = .13 BTU/(hr.) (sq. ft.) (F/in.) POLYURETHANE FOAM THICKNESS | | | | K = 0.24 BTU/(hr.) (sq. ft.) (F/in.) STYROFOAM THICKNESS | |
| | NONE | | ¾" | 1" | 1½" | 2" | 1½" | 2" |
| NONE | | | | | 7 hrs. | | | |
| | | | | | 3 hrs. | | | |
| GLAUBER'S | ½" | 17 hrs. | 35 hrs. | | 90 hrs. | | 54 hrs. | 63 hrs. |
| SALT | | | | | 28 hrs. | 39 hrs. | | |
| IMPREGNATED | | 4 | 19 hrs. | | **(3550 g) | | 20 hrs. | 26 hrs. |
| FOAM | ¾" | | | 64 hrs. | | | | |
| | | | | 25 hrs. | | | | |
| | APP | | | | 83 hrs. | | | |
| | ½" | | | | 36 hrs. | | | |
| | | | | | **(3700 g) | | | |

*Glauber's Salt Content 16 g/cub. in. of foam.
**Total weight of six panels of foam impregnated with Glauber Salt.

TABLE II

Insulation Protection of 8,000 Thermometer Packer
Number of Hours to Reach 93° F. in 100° F./120° F. Oven

| | | OUTER INSULATION | | | | |
|---|---|---|---|---|---|---|
| | | POLYURETANE FOAM THICKNESS K = .13 BTU/(hr) (sq. ft.) (F/in.) | | | STYROFOAM THICKNESS K = .24 BTU/(hr) (sq.ft) (F/in) | |
| | NONE | ¾" | 1" | 1½" | 1" | 1½" |
| | | 3 hrs. | | | | |
| Glauber's | | | 62 hrs. | 94 hrs. | | |
| Salt | | | 28 hrs. | 33 hrs. | | |
| Impregnated | | | | 94 hrs. | | |
| Foam* | | | | 40 hrs. | 24 hrs. | 25 hrs. |
| | | | | 68–83 hrs. | | 60 hrs. |
| | | | | 26–33 hrs. | | 26 hrs. |

TABLE II-continued

| Insulation Protection of 8,000 Thermometer Packer Number of Hours to Reach 93° F. in 100° F./120° F. Oven | |
|---|---|
| OUTER INSULATION | |
| POLYURETANE FOAM THICKNESS K = .13 BTU/(hr) (sq. ft.) (F/in.) | STYROFOAM THICKNESS K = .24 BTU/(hr) (sq.ft) (F/in) |
| 90 hrs. | |
| 43 hrs. | |

*Glauber's Salt Content 16 g/cu. in. of foam

TABLE III

| Insulation Protection of 2 Gross OTC Box. Numbers of Hours to Reach 93° F. in 100° F./120° F. Oven | | | | |
|---|---|---|---|---|
| | | 1½" Outer Insulation | | |
| | | PU W/O Corners K = .13 BTU/(hr.) (sq.ft) (F/in) | PU s/Corners K = .13 BTU/(hr.) (sq.ft) (F/in.) | Styrofoam K = .24 BTU/(hr) (sq.ft.) (F/in) |
| GLAUBER'S SALT IMPREGNATED ½" FOAM | Small Squares | 63 hrs. **1390 g | 60 hrs. | |
| | | 26 hrs. **1160 g | 23 hrs. **1010 g | 17 hrs. |
| | Rectangle | | 53 hrs. **1230 g | |
| | | | 25 hrs. **1350 g | |
| | Six Squares | | 54 hrs. **1340 g | |
| | | | 26 hrs. **1370 g | |

*Glauber's Salt Content 16 g/cu. in. of foam
**Total weight of six panels of foam impregnated with Glauber's Salt

EXAMPLE II mensions of the container to be protected as well as the refrigeration and insulating materials are known.

TABLE IV

Figure 2:
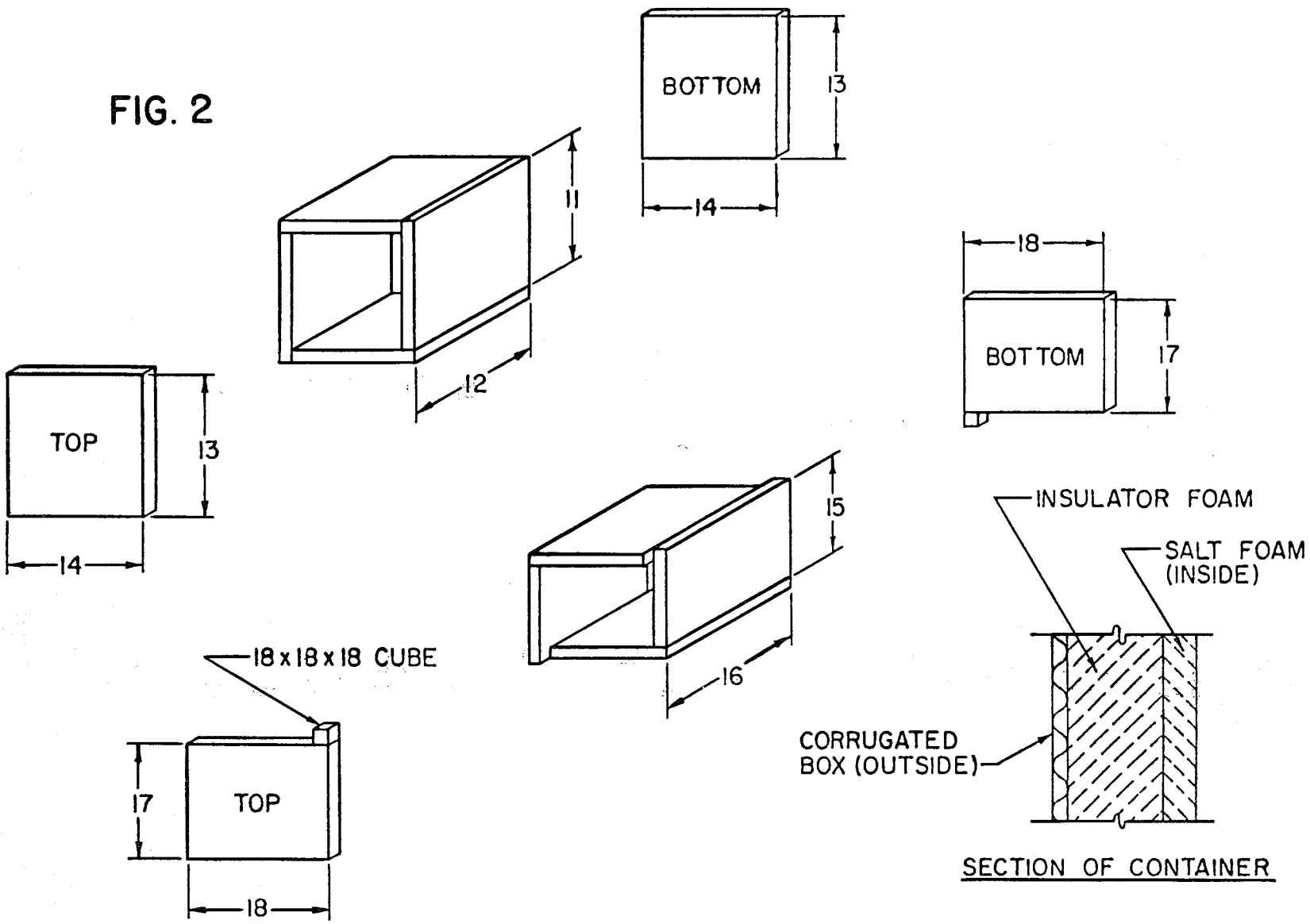

| | CONTENTS | THICKNESSES | PF FOAM DIMENSIONS | | | | | PU FOAM DIMENSIONS | | | | |
|---|---|---|---|---|---|---|---|---|---|---|---|---|
| | | | 1 | 2 | 3 | 4 | 5 | 6 | 7 | 8 | 9 | 10 |
| FIG. 1 | 2,000* | PF = ½" | 5¼" | 10¼" | 9¼" | 6" | 9¾" | | | | | |
| | | PU = 1½" | | | | | | 7¾" | 11⅝" | 11½" | 9¼" | 13" |
| | 8,000** | PF = 1" | 11¼" | 11¼" | 19 | 12½" | 20" | | | | | |
| | | PU = 1½" | | | | | | 14¼" | 13⅜" | 21¾" | 15¾" | 23¾" |
| | | | 11 | 12 | 13 | 14 | | 15 | 16 | 17 | 18 | |
| FIG. 2 | 2 Gross*** | PF = ½" | 5½" | 5½" | 5½" | 5½" | | | | | | |
| | | PU = 1½" | | | | | | 7½" | 7½" | 7½" | 7½" | |

*Corrugated shipping box inside diameter to be 9¼" wide × 14⅜" high × 13" deep.
**Corrugated shipping box inside diameter to be 23¼" wide × 15¾" high × 16⅜" deep.
***Corrugated shipping box inside diameter 9" wide × 9" high × 9" deep.

In FIGS. 1 and 2, preferred embodiments (generalized dimensions) are shown for cartons for shipping disposable thermometers sold under the mark TEMPA-DOT® READY STRIP® by Organon Inc., West Orange, N.J. Examples of using the generalized dimensions for particular sizes are given in Table IV; these dimensions may vary, of course, for other sizes selected by the user than shown in Table IV. Also Table V shows the parameters and their numerical determination used to determine the size of the insulating panels for a rectangular parallelopiped carton. The preferred embodiments were selected based upon the following goals: (1) the use of the minimum amount of refrigerant to reduce weight and shipping costs and (2) the use of the minimum amount of insulation to reduce cost of packaging. By combining the various combinations available, the selection made appears to be about the best for this application.

Table VI shows a means to determine the size of the outside shipping container that must be selected if the novel packaging system is to be utilized and if the di-

TABLE V

| Determination of Components for a Rectangular Parallelopiped Container |
|---|
| PF size Top & Bottom: 2 pcs. |
| = maximum packer outside top or bottom dimension + 2 PF thickness. (L & W) |
| PF size, Side Panels: 2 pcs. each |
| = maximum packer outside side dimensions + PF thickness |
| PF Height = maximum packer height |
| PU size Top and Bottom: 2 pcs. |
| = PF size + 2 PU thickness + ¼" (functional allowance of dimension tolerances) |
| PU size, Side Panels |
| = PF side panels + PF thickness + PU thickness + ¼" (functional allowance of dimension tolerances) |
| PU Height size = PF height + 2 PF thickness + 2 × ¼" (functional allowance of dimension tolerances) |
| PF = Phenol Formaldehyde foam laden with Glauber's Salt |
| PU = Polyurethane foam insulation with thermal conductivity K = .13 BTU/(hr.) (sq. ft.) (F/in.) |

TABLE VI

| Determination of Parallelopiped Container |
|---|
| Inside size of top & bottom of the shipper container = PU size of top & bottom panels (L & W). |
| The inside height of the shipper = the height of PU size = 2 PU thickness. |

EXAMPLE III

Another embodiment is disclosed for an insulated shipping container. The object is to require the use of only one size of insulated panel to achieve maximum economy.

In particular a cubic shipping container is selected of inside length equal to B. The insulation panels are then squares of side equal to B minus T, where T is equal to the thickness of the insulating material. Six of these square insulating sheets are then arranged as is shown in the accompaning Table VII such that all surfaces of the inside of the container are covered. There are two voids which occur at the diagonally opposite corners which may or may not be filled in with cubic pieces of insulating material of side length equal to T. Furthermore, the six Glauber's Salt impregnated PF foam panels are also similar square pieces where their dimensions will be D+T' where D is the maximum outer dimension of the packer. T' is the thickness of the Glauber's Salt impregnated panels.

The advantages of using this type of packaging system are:

1. Only one size of insulating panel and Glauber's Salt impregnated panel need be inventoried.
2. Since only one size of panel is used, economy for quantity discount is achieved in purchasing the panels.
3. Construction of the insulated shipper is simpler.
4. Warehousing space is conserved.
5. This system reduces wastage as opposed to conventional rectangular parallelopiped shaped insulating containers using at least three different sizes of panels which may not occur in equal numbers. Thus, if one panel of one size is lost then five panels are wasted.

The system is applicable to any type of sheet form of insulation known to those in the art such as foamed polyurethane, foamed polystyrene, urea formaldehyde or phenolformaldehyde.

TABLE VII

| Determination of Component Dimensions for a Cubical Shipper |
|---|
| PF[2] Size = Max. Packer[1] Outside Dimension (D) + PF Thickness (T') |
| FU[3] Size = PF Size + PF Thickness (T') + PU Thickness (T) + ¼" (Functional allowance of dimensional tolerances) |
| Shipper: Inside = PU Size + PU Thickness + ⅛" |
| ∴ Shipper Inside = Max. Packer Outside + 2 × PF Thickness + 2 × PU Thickness + ⅜" |

[1]"Packer" is the box going into the insulated container.
[2]"PF" is coolant absorbant foam.
[3]"PU" is insulating foam sheet.

As one in the art will realize from the embodiments herein, in order to protect thermolabile goods from low temperatures, one selects a compound having a freezing point slightly higher than the freezing point of the goods to be protected and employs same in an amount effective to protect the goods for a predetermined period of time when the temperature of the environment is below that of the freezing point of the compound. For additional protection, one may again surround the compound with a suitable insulator in a sufficient amount so that the rate of heat transfer through the insulator is less than the rate of heat transfer through the compound.

What is claimed is:

1. A method of protecting thermolabile goods having a thermosensitive temperature from high temperatures comprising:

completely enclosing said thermolabile goods with a non-permeable enclosed compound having a melting point slightly less than the thermosensitive temperature of said goods and having a capacity to absorb heat, in an amount effective to protect said goods when the temperature of the environment exceeds the melting point of said compound.

2. The method of claim 1 wherein said compound has a melting point about 3° to about 5° C. below the thermosensitive temperature of said goods.

3. The method of claim 1 wherein said compound is selected from the group consisting of sodium sulfate decahydrate, calcium chloride hexahydrate, potassium iron (III) sulfate.$24H_2O$, o-chloronitrobenzene, ammonium iron (III) sulfate.$12H_2O$, ammonium propionate, cadmium nitrate, sodium acetate trihydrate, sodium monohydrogen arsenate, sodium tetraborate decahydrate, sodium potassium tartrate tetrahydrate, sodium metasilicate pentahydrate, zinc sulfate heptahydrate, sodium orthophosphate decahydrate, sodium valerate, and potassium formate.

4. The method of claim 1 wherein said goods are thermometers.

5. The method of claim 4 wherein said thermometers are single use clinical thermometers.

6. The method of claim 1 wherein said compound is sealed in a flexible bag.

7. The method of claim 1 wherein said compound is closed in a rigid container.

8. The method of claim 1 wherein said compound is molten, absorbed into a bibulous material, and sealed in a flexible bag.

9. The method of claim 8 wherein said compound is sodium sulfate decahydrate, said bibulous material is an open cell phenol-formaldehyde foam, and said flexible bag is a heat sealed polyethylene bag.

10. The method of claim 1 wherein said compound is used in a water-free environment.

11. The method of claim 1 wherein said compound has a heat capacity of at least about 10 cal/g.

12. A method of protecting thermolabile goods having a thermosensitive temperature, from high temperatures, comprising:

(a) completely enclosing said thermolabile goods with a non-permeable enclosed compound having a melting point slightly less than the thermosensitive temperature of said goods and having the capacity to absorb heat, in an amount effective to protect said goods when the temperature of the environment exceeds the melting point of said compound; and (b) surrounding said compound with a suitable insulator in a sufficient amount so that the rate of heat transfer through the insulator is less than the rate of heat transfer through the compound.

13. The method of claim 12 wherein the insulator is polyurethane.

14. The method of claim 12 wherein said compound has a melting point about 3° to about 5° below the thermosensitive temperature of said goods.

15. The method of claim 12 wherein said compound is selected from the group consisting of sodium sulfate decahydrate, calcium chloride hexahydrate, potassium iron (III) sulfate.$24H_2O$, o-chloronitrobenzene, ammonium iron (III) sulfate.$12H_2O$, ammonium propionate, cadmium nitrate, sodium acetate trihydrate, sodium monohydrogen arsenate, sodium tetraborate decahydrate, sodium potassium tartrate tetrahydrate, sodium metasilicate pentahydrate, zinc sulfate heptahydrate, sodium orthophosphate decahydrate, sodium valerate, and potassium formate.

16. The method of claim 12 wherein said goods are thermometers.

17. The method of claim 16 wherein said thermometers are single use clinical thermometers.

18. The method of claim 12 wherein said compound is sealed in a flexible bag.

19. The method of claim 12 wherein said compound is closed in a rigid container.

20. The method of claim 12 wherein said compound is molten, absorbed into a bibulous material, and sealed in a flexible bag.

21. The method of claim 20 wherein said compound is sodium sulfate decahydrate, said bibulous material is an open cell phenol-formaldehyde foam, and said flexible bag is a heat sealed polyethylene bag.

22. The method of claim 12 wherein said compound is used in a water-free environment.

23. The method of claim 12 wherein said compound has a heat capacity of at least about 10 cal/g.

24. A container for protecting thermolabile goods having a thermosensitive temperature, from high temperatures, comprising:

a layer completely enclosing said goods comprising a non-permeable enclosing compound having a melting point slightly less than the thermosensitive temperature of said goods, and having a capacity to absorb heat, in an amount effective to protect sid goods when the temperature of the environment exceeds the melting point of the compound.

25. The container of claim 24 wherein said compound has a melting point about 3° C. to about 5° C. below the thermosensitive temperature of said goods.

26. The container of claim 24 wherein said compound is selected from the group consisting of sodium sulfate decahydrate, calcium chloride hexahydrate, potassium iron (III) sulfate.$24H_2O$, o-chloronitrobenzene, ammonium iron (III) sulfate.$12H_2O$, ammonium propionate, cadmium nitrate, sodium acetate trihydrate, sodium monohydrogen arsenate, sodium tetraborate decahydrate, sodium postassium tartrate tetrahydrate, sodium metasilicate pentahydrate, zinc sulfate heptahydrate, sodium orthophosphate decahydrate, sodium valerate, and potassium formate.

27. The container of claim 24 wherein said goods are thermometers.

28. The container of claim 27 wherein said thermometers are single use clinical thermometers.

29. The container of claim 24 wherein said compound is sealed in a flexible bag.

30. The container of claim 24 wherein said compound is closed in a rigid container.

31. The container of claim 24 wherein said compound is molten, absorbed into a bibulous material, and sealed in a flexible bag.

32. The container of claim 31 wherein said compound is sodium sulfate decahydrate, said bibulous material is an open cell phenol-formaldehyde foam, and said flexible bag is a heat sealed polyethylene bag.

33. The container of claim 24 wherein said compound is used in a water-free environment.

34. The container of claim 24 wherein said compound has a heat capacity of at least about 10 cal/g.

35. A container for protecting thermolabile goods having a thermosensitive temperature, from high temperatures, comprising:

(a) a layer completely enclosing said thermolabile goods comprising a non-permeable enclosing compound having a melting point slightly less than the thermosensitive temperature of said goods and having the capacity to absorb heat, in an amount effective to protect said goods when the temperature of the environment exceeds the melting point of said compound; and (b) a layer surrounding said compound comprising a suitable insulator, in a sufficient amount so that the rate of heat transfer through the insulator is less than the rate of heat transfer through the compound.

36. The container of claim 35 wherein the insulator is polyurethane.

37. The container of claim 35 wherein said compound has a melting point about 3° to about 5° below the thermosensitive temperature of said goods.

38. The container of claim 35 wherein said compound is selected from the group consisting of sodium sulfate decahydrate, calcium chloride hexahydrate, potassium iron (III) sulfate.$24H_2O$, o-chloronitrobenzene, ammonium iron (III) sulfate.$12H_2O$, ammonium propionate, cadmium nitrate, sodium acetate trihydrate, sodium monohydrogen arsenate, sodium tetraborate decahydrate, sodium potassium tartrate tetrahydrate, sodium metasilicate pentahydrate, zinc sulfate heptahydrate, sodium orthophosphate decahydrate, sodium valerate, and potassium formate.

39. The container of claim 35 wherein said goods are thermometers.

40. The container of claim 35 wherein said thermometers are single use clinical thermometers.

41. The container of claim 35 wherein said compound is sealed in a flexible bag.

42. The container of claim 35 wherein said compound is closed in a rigid container.

43. The container of claim 35 wherein said compound is molten, absorbed into a bibulous material, and sealed in a flexible bag.

44. The container of claim 43 wherein said compound is sodium sulfate decahydrate, said bibulous material is an open cell phenol-formaldehyde foam, and said flexible bag is a heat sealed polyethylene bag.

45. The container of claim 35 wherein said compound is used in a water-free environment.

46. The container of claim 35 wherein said compound has a heat capacity of at least about 10 cal/g.

* * * * *